US010789838B2

(12) United States Patent
Amacker

(10) Patent No.: US 10,789,838 B2
(45) Date of Patent: Sep. 29, 2020

(54) DYNAMICALLY UPDATING ULTRA-WIDE BAND ROAD MARKERS

(71) Applicant: TOYOTA RESEARCH INSTITUTE, INC., Los Altos, CA (US)

(72) Inventor: Matt Amacker, Santa Clara, CA (US)

(73) Assignee: TOYOTA RESEARCH INSTITUTE, INC., Los Altos, CA (US)

( * ) Notice: Subject to any disclaimer, the term of this patent is extended or adjusted under 35 U.S.C. 154(b) by 12 days.

(21) Appl. No.: 16/157,587

(22) Filed: Oct. 11, 2018

(65) Prior Publication Data

US 2020/0118431 A1 Apr. 16, 2020

(51) Int. Cl.

| | |
|---|---|
| ***G08G 1/09*** | (2006.01) |
| ***E01F 9/688*** | (2016.01) |
| ***E01F 9/654*** | (2016.01) |
| ***G08G 1/0967*** | (2006.01) |
| ***E01F 9/30*** | (2016.01) |

(52) U.S. Cl.

CPC ..... *G08G 1/094* (2013.01); *E01F 9/30* (2016.02); *G08G 1/096716* (2013.01); *G08G 1/096783* (2013.01); *E01F 9/654* (2016.02); *E01F 9/688* (2016.02)

(58) Field of Classification Search

None

See application file for complete search history.

(56) References Cited

U.S. PATENT DOCUMENTS 4,359,733 A * 11/1982 O'Neill ..... G01S 5/14 342/357.31
4,687,369 A * 8/1987 McDonald ..... E01F 9/688 116/63 P
5,129,605 A * 7/1992 Burns ..... B61L 25/021 246/122 R
5,437,422 A * 8/1995 Newman ..... B61L 27/0038 246/5
5,554,982 A * 9/1996 Shirkey ..... B61L 3/004 246/122 R
5,793,329 A * 8/1998 Nakada ..... G01V 3/12 342/357.53
5,823,481 A * 10/1998 Gottschlich ..... B61L 3/24 246/28 R
6,371,416 B1 * 4/2002 Hawthorne ..... B61L 23/06 246/122 R (Continued)

*Primary Examiner* — Steven Lim
*Assistant Examiner* — Muhammad Adnan
(74) *Attorney, Agent, or Firm* — Oblon, McClelland, Maier & Neustadt, L.L.P.

(57) ABSTRACT

Provided is an apparatus and method for dynamically communicating information of an area of interest by way of road marker devices, such as road cones, pucks, barricade, or the like. The apparatus may communication information for areas of interest including road work zones, traffic accidents, disabled vehicles, or other road hazards. The road marker devices include processing circuitry configured to determine a peripheral shape as a boundary indicated by the road marker devices as the information of the area of interest, and communicate the information of the peripheral shape from a marker device to vehicles approaching the area of interest. The road markers may communicate information of the area of interest to autonomous vehicles, or vehicles having certain sensors.

20 Claims, 7 Drawing Sheets

(56) References Cited

U.S. PATENT DOCUMENTS

| | | | | |
|---|---|---|---|---|
| 6,853,888 | B2 * | 2/2005 | Kane | B61L 3/125 701/19 |
| 7,142,982 | B2 * | 11/2006 | Hickenlooper | B61L 25/025 701/489 |
| 7,397,390 | B2 | 7/2008 | Dipiazza | |
| 7,859,428 | B2 | 12/2010 | Boss et al. | |
| 9,043,124 | B1 * | 5/2015 | Tran | G08G 1/02 701/117 |
| 9,127,420 | B2 * | 9/2015 | Ko | H05B 47/11 |
| 9,478,129 | B1 * | 10/2016 | Kothari | G08G 1/087 |
| 9,898,759 | B2 * | 2/2018 | Khoury | G08G 1/0129 |
| 9,902,411 | B2 * | 2/2018 | Bartek | B61L 25/026 |
| 9,930,120 | B2 * | 3/2018 | Gutierrez | H04L 67/12 |
| 9,959,754 | B1 * | 5/2018 | King | G08G 1/095 |
| 2004/0130463 | A1 * | 7/2004 | Bloomquist | G08G 1/096716 340/907 |
| 2007/0085734 | A1 * | 4/2007 | Whitehead | G01S 19/07 342/357.24 |
| 2013/0276315 | A1 * | 10/2013 | Kahle | G01C 15/06 33/228 |
| 2014/0368373 | A1 * | 12/2014 | Crain | G01S 5/02 342/5 |
| 2015/0089606 | A1 * | 3/2015 | Wang | H04W 12/04 726/5 |
| 2015/0266471 | A1 * | 9/2015 | Ferguson | B60W 30/00 701/23 |
| 2016/0076207 | A1 * | 3/2016 | Moran | E01F 9/30 340/905 |
| 2016/0087486 | A1 * | 3/2016 | Pogorelik | H02J 7/025 320/108 |
| 2017/0088046 | A1 * | 3/2017 | Denny | B60Q 7/00 |
| 2018/0038939 | A1 * | 2/2018 | Bruemmer | G01S 5/0289 |
| 2018/0142436 | A1 * | 5/2018 | Agajanian | E01F 9/615 |

* cited by examiner

DYNAMICALLY UPDATING ULTRA-WIDE BAND ROAD MARKERS

FIELD OF DISCLOSURE

The present disclosure relates generally to road markers that connect to one another and to a vehicle or network, in particular, road markers that indicate and broadcast to the vehicle or network an area of interest.

BACKGROUND

Road obstacles, such as road work zones, traffic accidents, and disabled vehicles may be visually indicated by one or more road cones, flashing lights, signs, or flares. Often, visual notification of traffic accidents or disabled vehicles may be located in close proximity to the incident, providing little warning to vehicle drivers as they approach the scene of the accident or disabled vehicle. Road work zones may be visually indicated by temporary road signs, or even portable signs with flashing lights, sometimes located just a few hundred yards before the zone. In some major highways, large displays may display text that indicates traffic conditions, and even if there is a traffic accident or road work zone.

Recent technology has become available in the way of mobile apps, or in some cases, apps that run in automobile navigation systems, that provide messages concerning traffic conditions, accidents, disabled vehicles, road work zones, and may even provide a warning that a police vehicle is located in a certain area. One mobile app works by way of an initial user(s) that first spots an incident and sends out a message via the mobile app to inform others of the incident. The location of the incident may be obtained based on the current location of the informant mobile device when the notification is entered into the app. The mobile app requires that information concerning an incident be accurately entered. It is possible that the exact location may not have been entered at the time of first entry of information about an incident. Also, drivers of vehicles that do not have access to the mobile app will not be informed of an incident that other drivers have spotted, or drivers without the app will not be able to inform other drivers of the incident.

There is a need for an approach to informing drivers of vehicles of incidents, such as road work zones, automobile accidents, disabled vehicles, sections of road that may be impassible due to floods, large pot holes, etc., or any other reason that a driver should be warned about traffic conditions in a certain area. There is a need to notify drivers of vehicles of incidents in a certain area at a time that the incident is marked, rather than as others have already come into view of the incident. There is a need for dynamically updating a boundary around a certain incident in the event that boundary of the incident changes over time, such as a moving road work zone. These and other problems are addressed by the present disclosure.

SUMMARY

According to an embodiment of the present disclosure, there is provided a method of dynamically communicating information of an area of interest. The method including powering on and initiating communications in at least one marker device, determining a peripheral shape indicated by the at least one marker device as the information of the area of interest, and communicating the information from the at least one marker device.

Further, according to an embodiment of the present disclosure, there is provided an apparatus for dynamically communicating information of an area of interest, the apparatus including at least one road marker device including processing circuitry configured to determine a peripheral shape indicated by the at least one road marker device as the information of the area of interest, and communicate the information from the at least one marker device.

The foregoing "Background" description is for the purpose of generally presenting the context of the disclosure. Work of the inventors, to the extent it is described in this background section, as well as aspects of the description which may not otherwise qualify as prior art at the time of filing, are neither expressly or impliedly admitted as prior art against the present invention.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
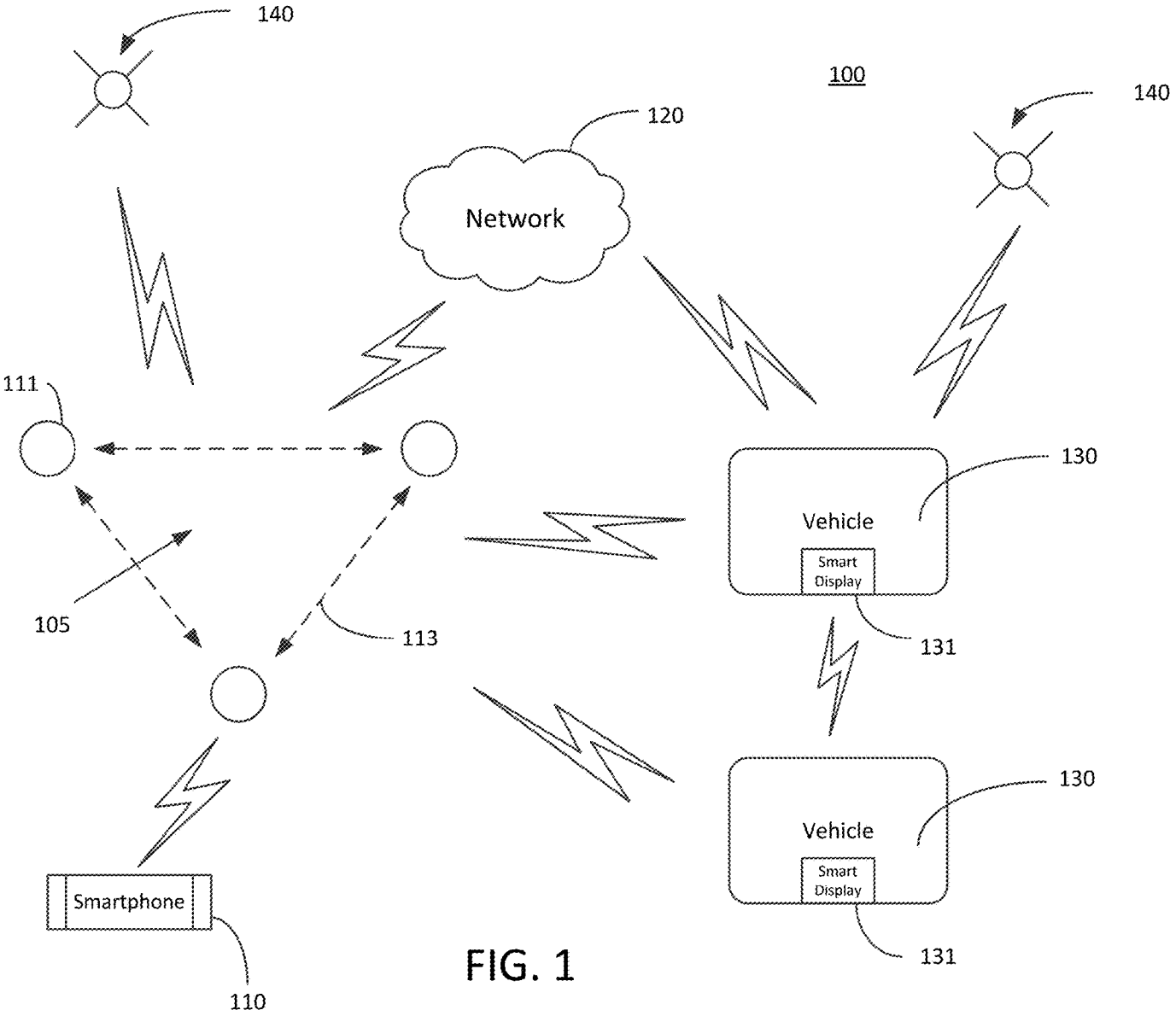
FIG. 1 is a system diagram in accordance with an exemplary aspect of the disclosure.

The description set forth below in connection with the appended drawings is intended as a description of various embodiments of the disclosed subject matter and is not necessarily intended to represent the only embodiment(s). In certain instances, the description includes specific details for the purpose of providing an understanding of the disclosed embodiment(s). However, it will be apparent to those skilled in the art that the disclosed embodiment(s) may be practiced without those specific details. In some instances, well-known structures and components may be shown in block diagram form in order to avoid obscuring the concepts of the disclosed subject matter.

As used herein any reference to "one embodiment" or "some embodiments" or "an embodiment" means that a particular element, feature, structure, or characteristic described in connection with the embodiment is included in at least one embodiment. The appearances of the phrase "in one embodiment" in various places in the specification are not necessarily all referring to the same embodiment. Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. In addition, the articles "a" and "an" as used in this application and the appended claims are to be construed to mean "one or more" or "at least one" unless specified otherwise.

Furthermore, the terms "approximately," "proximate," "minor," and similar terms generally refer to ranges that include the identified value within a margin of 20%, 10% or preferably 5% in certain embodiments, and any values therebetween.

Referring now to the drawings, wherein like reference numerals designate identical or corresponding parts throughout several views, the following description relates to a dynamic system of road cones or other indicia that automatically generate a digital boundary around a location of interest by placement and connection of road cones having communications capability.

FIG. 1 is a system diagram in accordance with an exemplary aspect of the disclosure. The system 100 includes one or more road markers 111 that are configured to communicate, and may have a computer that performs processing. In some embodiments, two or more road markers 111 may physically define an area 105, referred to herein as an area of interest. For purposes of this disclosure, an area of interest is a physical area that is to be avoided by automotive vehicles. In some cases, the area may be temporary, such as a crosswalk. In other cases, the area is to be avoided because it may be a hazard to vehicles, or because work is being done within the area by one or more persons. The road markers 111 may communicate with each other over a communications channel 113. One or more of the road markers 111 may also communicate with devices other than the other road markers and may communicate with a network 120 or satellite 140, or other points of entry in order to communicate by way of the Internet, or other network communications protocol. One or more of the road markers 111 may communicate with a mobile device 110, such as a smartphone. One or more of the road markers 111 may communicate directly with automotive vehicles 130. The road markers 111 may also communicate indirectly with automotive vehicles 130 by way of satellite 140 or a network 120.

A road marker 111 may take any of various forms, such as a road cone, a puck, a barricade, a fence, or other object that can contain a small computer and/or communications device, and that preferably can withstand various weather conditions. In some embodiments, the road marker 111 should also be visible to drivers of automotive vehicles. In some embodiments, a road marker 111 may itself be a display device or lighting device. In some embodiments, a road marker 111 may be a ruggedized transceiver device or computer device contained in a housing that is made to withstand weather conditions and that is detected through communication with a sensor, such as a radio wave communications device.

In this disclosure, the term automotive vehicle applies to automobiles, trucks, buses, motor cycles and tractor trailers. An automotive vehicle may include autonomous or self-driving vehicles. Over time, most automotive vehicles will be equipped with sensors, communications functions and processing functions that augment or replace operations performed by a vehicle driver. For example, most automotive vehicles have built-in navigation functions or at least messaging functions, in which information about traffic conditions may be received and either displayed or spoken.

Automotive vehicles 130 may have built-in smart display devices 131. A built-in smart display device 131 may provide an interactive interface for access to various pre-programmed applications, such as radio and cabin environment control, that have previously been available by way of knobs and levers, and newer functions such as navigation, GPS, audio, phone connectivity, fuel economy, traffic, and weather, by way of a suite of apps. Because the smart display device can provide information on the status of the vehicle, such as fuel economy, as well as entertainment, such as radio, the smart display device may be part of an infotainment system. An example of an infotainment system is Toyota Entune®. In some cases, many of the same functions available in the smart display device are also available for a mobile device. Toyota for example offers an Entune® app.

A built-in display device 131 may be part of an in-vehicle computer system, or infotainment system. The infotainment system may be a computer-based system that includes communications circuitry for short range communications. Examples of short range communications may include WiFi®, Bluetooth®, a cellular network, direct transmission such as millimeter wave, ultrasonic, or laser. One or more of these communications circuitry may be used for external communication with a server computer system 120. The server computer system 120 may be the Internet, or some other network-based computer system.

Although the system of FIG. 1 includes a built-in display device 131, the system need not be limited to a built-in device. The display device included in the vehicle may be a separate stand-alone mobile device, such as a tablet computer or any display device having a wired or wireless communications interface. For purposes of this disclosure, a mobile device that is used inside of an automotive vehicle, or carried aboard the automotive vehicle, will be referred to as an in-vehicle mobile device. A mobile device 110 that is used for communication with the road markers, and that may be taken out of an automotive vehicle 130, will be referred to as an external mobile device. It should be understood, that in some cases an in-vehicle mobile device may be the same device as the external mobile device 110. In other words, the nomenclature refers to the location that the mobile device is being used. That is an in-vehicle mobile device may be taken out of the automotive vehicle. As will be discussed later, an external mobile device 110 may be a certain smartphone that is used to communicate with the road markers for purposes of programming, initialization, etc. In most cases, the in-vehicle mobile device 131 may communicate with the road markers 111 for purposes of receiving an alert message related to an area of interest.

An in-vehicle mobile device may be provided with a mobile app that enables the in-vehicle mobile device to perform some of the same functions as a built-in display 131. In an exemplary aspect, the in-vehicle mobile device may be used as the display device in place of a built-in display device 131. In some embodiments, the vehicle is not equipped with a built-in display device 131, and the in-vehicle mobile device is provided as the sole interactive display device for the vehicle. The in-vehicle mobile device may be any of a number of types of mobile devices, including, but not limited to, a smartphone, a tablet, a laptop computer, or other computing device having a display and a means for interacting with the display, and a connection means to enable communications with the vehicle and/or with an external computer system 120. The means for interacting with the display may be a touchscreen or a pointing device, and may also include technologies such as eye gaze direction.

In embodiments of the present disclosure, an app may be provided for the vehicle infotainment system, or a comparable app may be provided for a mobile device to offer alert-related services. In some embodiments, the mobile app may be used to access services without being connected to the vehicle, or being physically within the vehicle compartment, or proximate to the vehicle. In some embodiments, the mobile device is associated with more than one vehicle, and the mobile device may be used to select a particular vehicle in order to use the app for a particular vehicle. In some embodiments, either the mobile app or the built-in display may be used for alert-related services.

Figure 2:
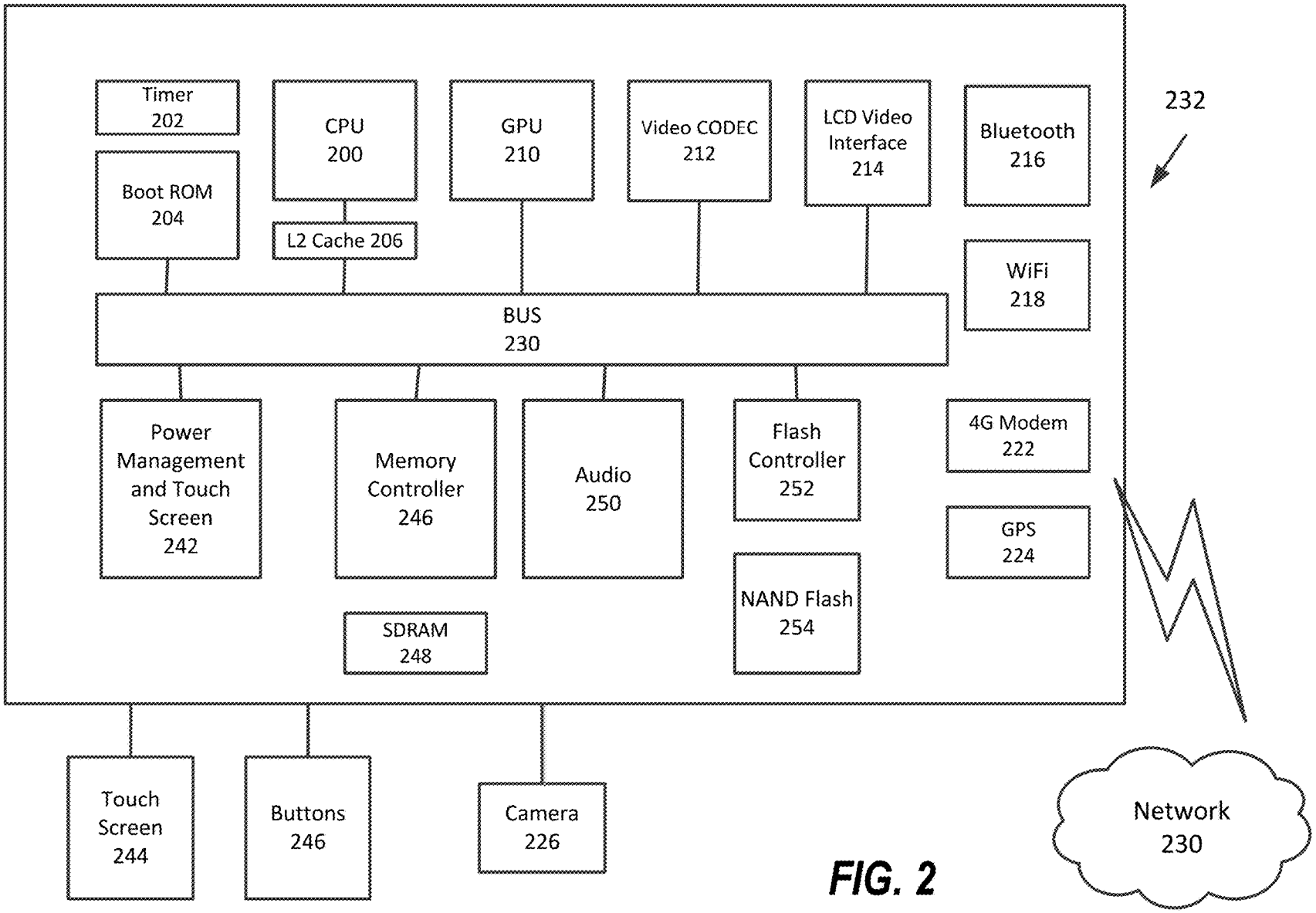
FIG. 2 is a diagram of a computer system in a mobile device.

FIG. 2 is a block diagram for an exemplary computer system for a built-in smart display device for an automotive vehicle. The description of the exemplary computer system may apply as well to mobile devices, i.e., either in-vehicle mobile devices or external mobile devices. The exemplary computer system is presented for purposes of explaining an example of a general smart display device, as smart display devices vary between makes and models of automotive vehicles. In one implementation, the functions and processes of the smart display device 131 or mobile device may be implemented by a computer system 232. Next, a hardware description of the computer system 232 according to exemplary embodiments is described with reference to FIG. 2. Regarding FIG. 2, the computer system 232 includes a CPU 200. Process data and instructions may be stored in memory, such as SDRAM 248. Further, the computer system 232 is not limited by the form of the computer-readable media on which the instructions are stored. For example, the instructions may be stored on CDs, DVDs, in FLASH memory, RAM, ROM, PROM, EPROM, EEPROM, hard disk or in another information processing device with which the computer system 232 communicates, such as a server or computer.

Further, automotive vehicles may be provided with a utility application, background daemon, or component of an operating system, or combination thereof, executing in conjunction with CPU 200 and an operating system such as LINUX®, Microsoft Windows®, Android, iOS, BlackBerry and other operating systems known to those skilled in the art.

In order to achieve the computer system 232, the hardware elements may be realized by various circuitry elements, known to those skilled in the art. For example, CPU 200 may be a quad-core ARM processor from Qualcomm, or an Intel Atom processor, or may be other processor types that would be recognized by one of ordinary skill in the art. The CPU 200 may also include a Cache 206 and a GPU 210. Special purposes devices include a timer 202, a boot ROM 204, power management and touch screen control 242, flash 254 and an associated flash controller 252. Alternatively, the CPU 200 may be implemented on an FPGA, ASIC, PLD or using discrete logic circuits, as one of ordinary skill in the art would recognize. Further, CPU 200 may be implemented as multiple processors cooperatively working in parallel to perform the instructions.

The computer 232 in FIG. 2 may also include various communications processors, including a Bluetooth processor 216, WiFi processor 222, a modem 222 for cellular communication, and a GPS processor 224. As can be appreciated, the network 230 can be a public network, such as the Internet, or a private network such as LAN or WAN network, or any combination thereof and can also include PSTN or ISDN sub-networks.

The computer system 232 may further include a video processor 212 and a LCD Video interface 214. The computer system 232 may include a touch screen 244, and buttons 246. In the case of a built-in smart display device, the computer system 232 may be connected to one or more cameras 226 mounted to the automotive vehicle 130. In other mobile devices, at least one camera 226 may be a component of the mobile device 110.

Communication between each road marker 111 may be by short range wireless communications or by a wired connection. In some embodiments, the road markers 111 may be part of a larger communications network that provides information to an external computer system. Examples of short range communications may include WiFi®, Bluetooth®, a cellular network, direct transmission such as millimeter wave, ultrasonic, or laser. One or more of these communications circuitry may be used for external communication as well. In the case of a communications network, the road markers 111 may be connected to an external computer system through WiFi® wireless communication or cellular communication. The road markers 111 may be interconnected to each other through Bluetooth Low Energy (LE) and Ultra-Wide Band (UWB) communication. UWB is a radio technology for short-range, high-bandwidth (greater than 500 MHz) communications. In some embodiments, road markers 111 include communication transceivers for the associated communications protocol. In some embodiments, at least one road marker 111 also includes a communications processor for each supported communications protocol. In one embodiment, the road markers 111 include a Bluetooth low energy communications processor and transceiver.

In some embodiments, one or more of the road markers may be equipped with a computer. The computer may be a programmable computer or computation circuitry for performing certain specialized functions. One specialized function is calculation of a shape of a boundary of an area of interest. This function will be explained in more detail below.

Figure 3:
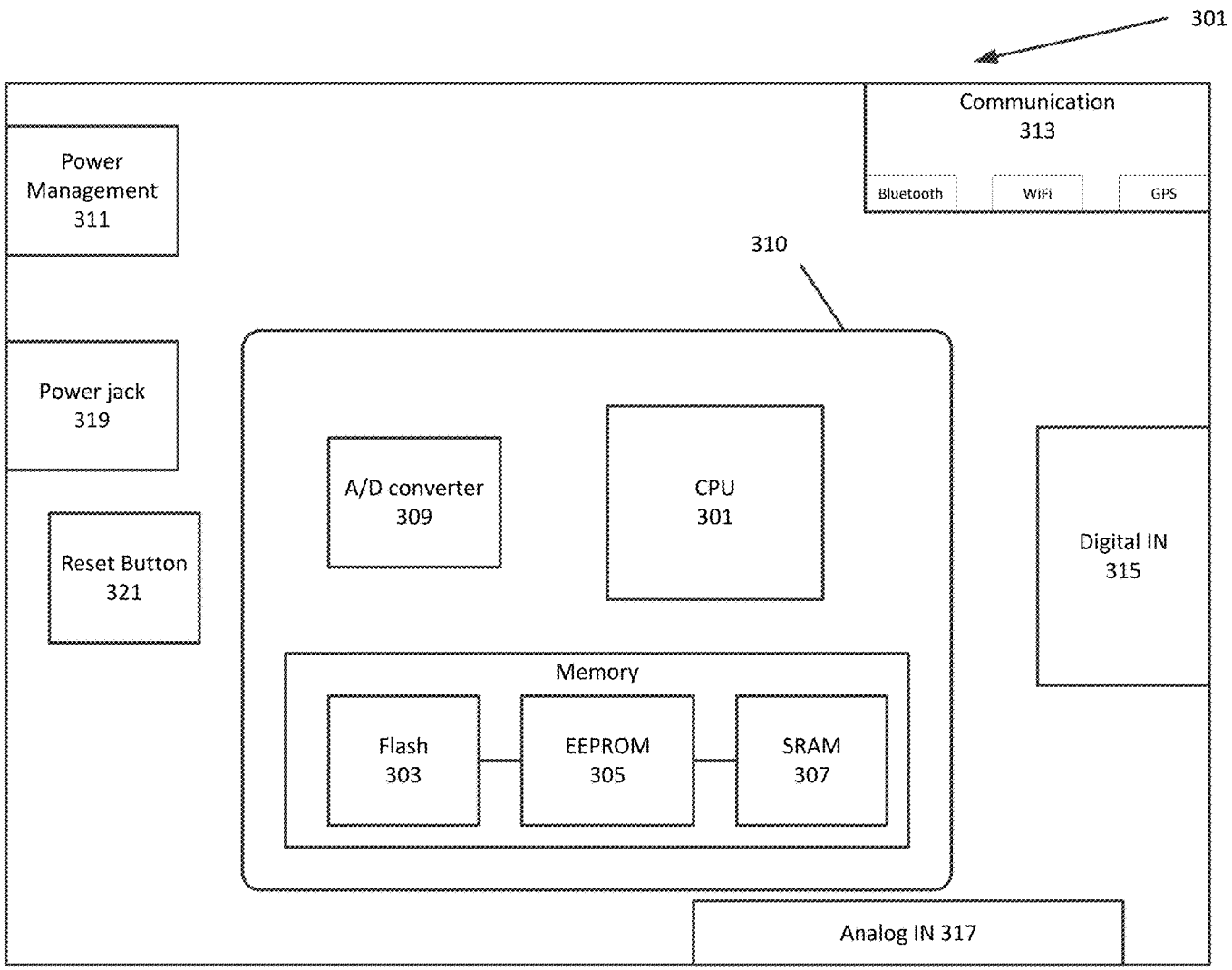
FIG. 3 is a diagram of a controller in a road marker in accordance with an exemplary aspect of the disclosure.

FIG. 3 is a diagram of a computer system in a road marker according to an exemplary aspect of the disclosure. The road marker computer system 301 may be a circuit board having a minimal number of components. The components may include at least one processing circuitry (CPU 301) having one or more processing cores and memory for storing an operating system and programming instructions. The memory may include non-volatile memory of one or more of types including Flash memory 303, and Electronically Erasable Programmable Read Only Memory (EEPROM 305). Secondary RAM 307 may be used to store instructions and data being processed. In some embodiments, the processing circuitry 301 and memory may be included on a single chip 310. In one embodiment, the computer-based system is an integrated circuit board 301 with a quad-core processor 310. The board includes digital I/O pins 315, analog inputs 317, hardware serial ports 313, a USB connection 311, a power jack 319, and a reset button 321. It should be understood that other circuit board configurations are possible. Variations can include the number of pins, whether or not the board includes communication ports or a reset button.

Although the description is of a particular circuit board, it should be understood that other computer system boards may be used. Processing circuitry 301 may vary based on the number of processing cores, size of non-volatile memory, the size of data memory, as well as whether or not it includes an A/D converter 309 or D/A converter.

Figure 4B:
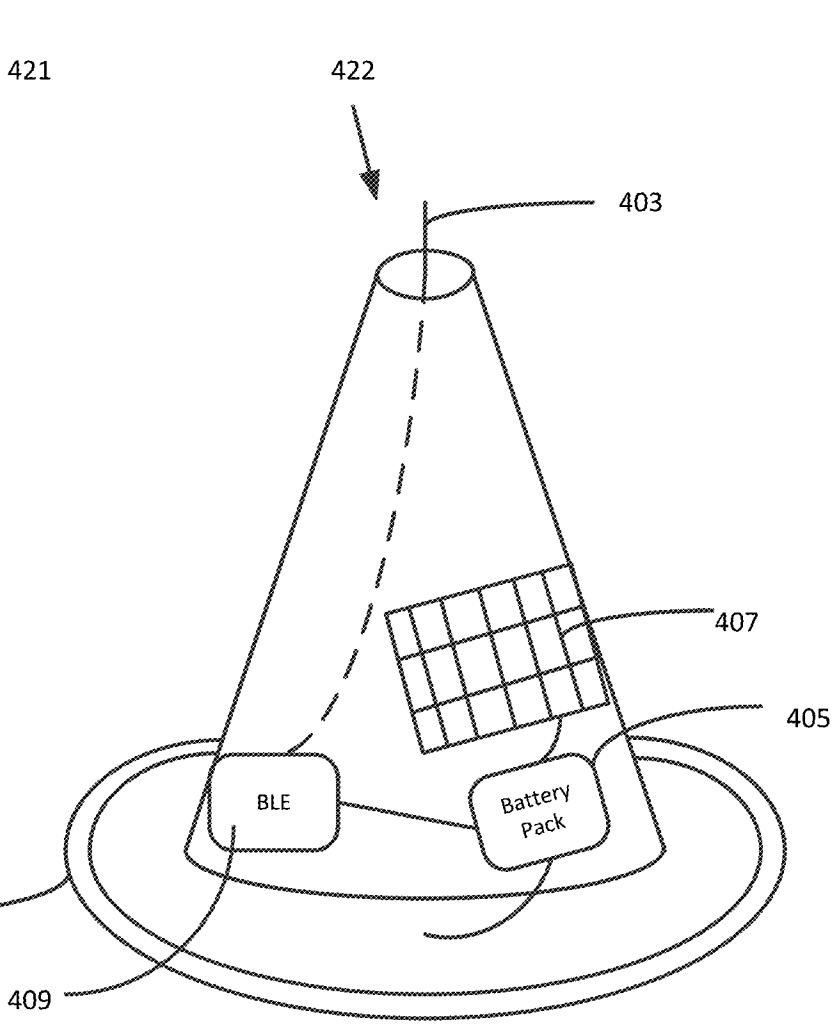
FIGS. 4A and 4B is a schematic of a road cone in accordance with an exemplary aspect of the disclosure.
Figure 4A:
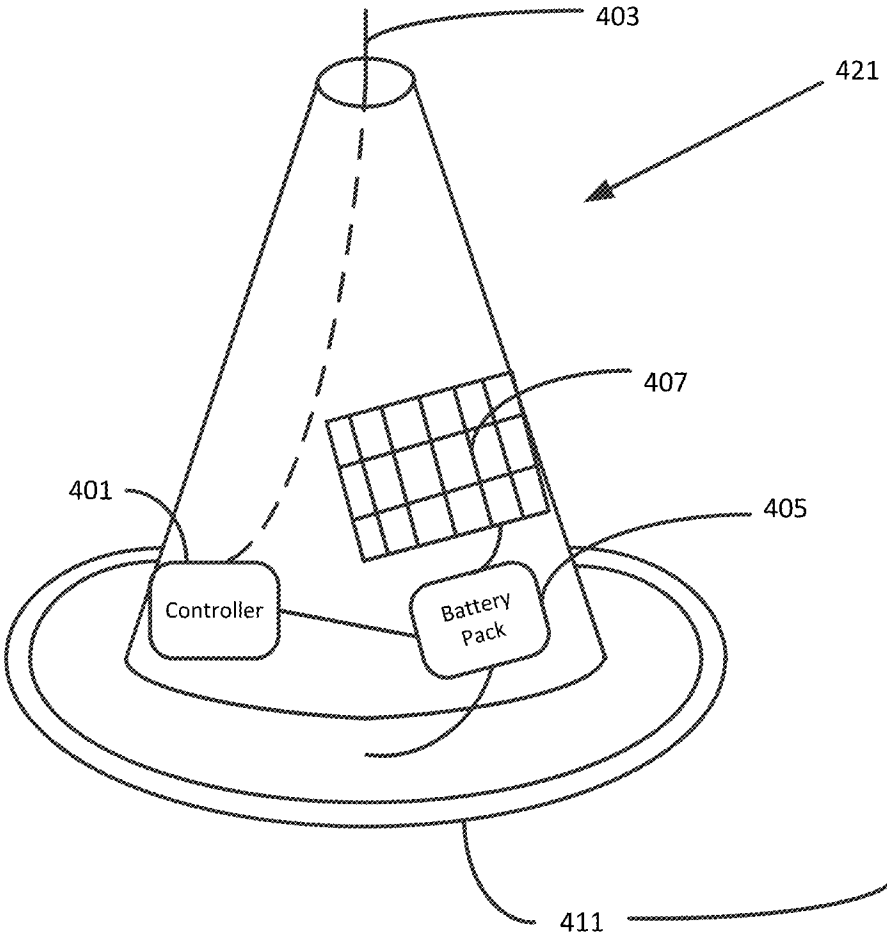

FIGS. 4A and 4B is a schematic of road markers in the form of cones in accordance with an exemplary aspect of the disclosure. Although road cones are illustrated, the configuration that is described applies as well to other forms of the road markers 111. At least one road cone 421 may be configured with a controller 401. In some embodiments, additional road cones 422 may be configured with a communications module, such as Bluetooth Low Energy 409. In order to facilitate communication, the road cones 421, 422 may be configured with one or more antenna 403. For ease of identification, road cones 421 and 422 may be of different colors, such as yellow and orange, and may be configured with an exterior display or light indicator to indicate that the internal controller 401 or communications module 409 is powered on. In some embodiments, the road cones 421, 422 may be fitted with sustainable power supplies and energy stores, such as solar panels 407 and battery banks 405. The road cones 421, 422 may recharge batteries during sunlight hours for sustained operation of the road cones 421, 422 at night. In some embodiments, one or more of the road cones 421, 422 may be fitted with a piezoelectric matt 411 that converts mechanical energy into electric current as the matt is compressed. The matt 411 may be placed on a road or a sidewalk and as the matt is compressed it may generate current to charge the battery banks on the road cone. Alternatively, the matt 411 may simply function as a switch to turn the controller 401 or communications module 409 on. In some embodiments, each road cone 421, 422 may have an exterior low power indicator light that indicates that the controller 401 or communications module 405 is not receiving sufficient power, or that the rechargeable battery pack is low voltage and requires recharging.

In some embodiments, one or more of a group of road markers 111 may be placed in a power-save setting, such that various features of the road marker are disabled to reduce a power drain. For example, in a system having four road marker indicating the location of a crosswalk, only one road marker may be placed in a connection mode such that it makes a connection with automotive vehicles or the network, and the remaining three road markers may be placed in a low-power mode wherein the three remaining road markers only interact with the fourth road cone in connection mode. The system of road markers may be configured to automatically adjust power drain settings in order to maximize the energy stores on hand. In such embodiments, switching from a power-save mode to a full communication mode may occur by transmission of a request for communication signal to a marker in connection mode. In some embodiments, road markers 111 may be turned off by way of a switch, or automatically when the road marker 111 is lifted off of the ground.

In some embodiments, sensors may be attached to the circuit board by way of the Digital IN 315 or Analog IN 317, and may include an accelerometer to detect that a road marker has been moved, or knocked over, a radar to detect a distance to a moving vehicle, a camera to take pictures of vehicles that violate or approach to near an area of interest.

In some embodiments, an infrared (IR) reflective coating or partial coating may be applied to the road markers. Such a coating may be used to trigger an IR camera of the automotive vehicle to cause the vehicle to begin looking for an area of interest in the vicinity of the vehicle.

The road markers 111 may indicate and broadcast an area of interest. A single road marker 111 may operate in a mode, referred to as a radius mode, to broadcast a stored predetermined shape such as a circle or a square of certain dimensions. In some embodiments, other road markers 111 may together determine the physical size of the area of interest, and the single road marker 111 may broadcast a size of the predetermined shape based on the physical locations of the other road markers 111. For example, a radius of a circle may be determined based on a distance between two road markers 111, the radius being half of this distance. In a similar manner, dimensions of a square area of interest may be determined based on a distance between two road markers 111. A location of the square area of interest may be based on a third road marker 111 that indicates a second side of the square.

As an alternative to radius mode, in a fence mode two or more road markers may mark the extent of an area of interest. Two road markers may be used to form a fence line that indicates an extent of an area of interest and a line that vehicles should not cross. Three or more road markers may form a boundary of an area of interest.

In the case of three or more road markers, a shape formed by the road markers may be determined based on the distance between road markers. Distance between road markers may be calculated by time-of-flight (ToF) communication between road markers. ToF measurement involves transmitting an identifiable, unique bitstream from the master transceiver, echoing it back either passively or actively from the slave transceiver, and measuring either the time taken for the round trip, or for shorter distances, phase differences between outgoing and incoming signals. Distance is determined from the period of time taken to transmit a signal, which may include processing time. The master road marker may determine a shape based on the number of vertices and the distance between pairs of vertices (road markers). For example, given three road markers, the distance between pairs of road markers can be used to calculate the angle between lines, which defines the shape and size of the triangle.

Figure 5:
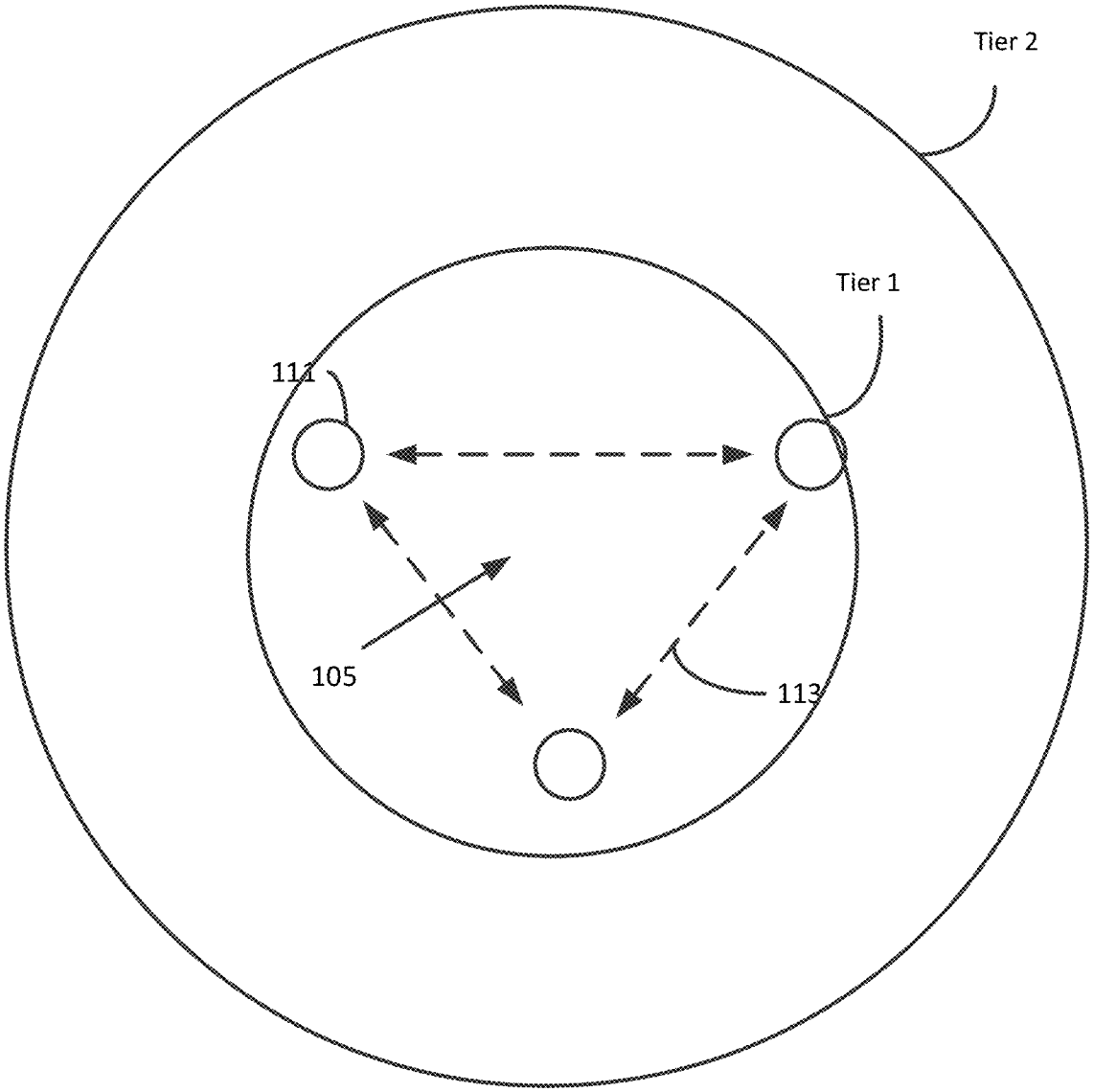
FIG. 5 is a diagram illustrating tiers in accordance with an exemplary aspect of the disclosure.

FIG. 5 is a diagram illustrating an arrangement of road markers that have been set up to broadcast multiple boundaries, defining tiers in accordance with an exemplary aspect of the disclosure. In some embodiments, the fence or radius modes that define a boundary for the area of interest may define additional boundaries at various distances from the area of interest. The additional boundaries may have associated tiers of actions. For example, a first tier (Tier 1) may be an innermost ring (an innermost boundary that is closest to the area of interest) of the radius or fence mode with an action of broadcasting an indication that an autonomous vehicle is prohibited from crossing the innermost boundary. This ring may be at or proximate to the road marker, or the radius or fence boundary. A second tier (Tier 2) may have an action of requiring the vehicle to slow to a certain speed in order to drive more cautiously within the particular tier of the area of interest. The second tier (Tier 2) may be a second boundary that is at or proximate to a predetermined distance from the innermost ring. A third tier may be a third boundary, with an action in which when the boundary is crossed, may require an autonomous vehicle to broadcast the location of the area of interest and the locations of the three tiers to a network or to other automotive vehicles within a certain radius from the area of interest.

In one embodiment, the various tiers of actions may be implemented using cost maps. In this embodiment, each tier may have a certain risk level. When an automotive vehicle enters an area defined by a tier, the risk level will change to the level corresponding to the respective tier.

In some embodiments, the areas of interest may be programmed into a road marker that includes a programmable computer using a wireless device, such as a handheld mobile device 110. Programming may be performed by uploading a configuration file into a memory of the controller of a road marker, may be performed by transmitting certain settings as attribute-value pairs, or may be performed by directly accessing and modifying code stored in memory of the road marker controller. The area of interest may be labeled and various settings may be programmed for the area of interest such as the level of sharing on the network or with vehicles. For example, the area of interest may be public, private, or disclosed to only certain entities on the network.

Figure 6:
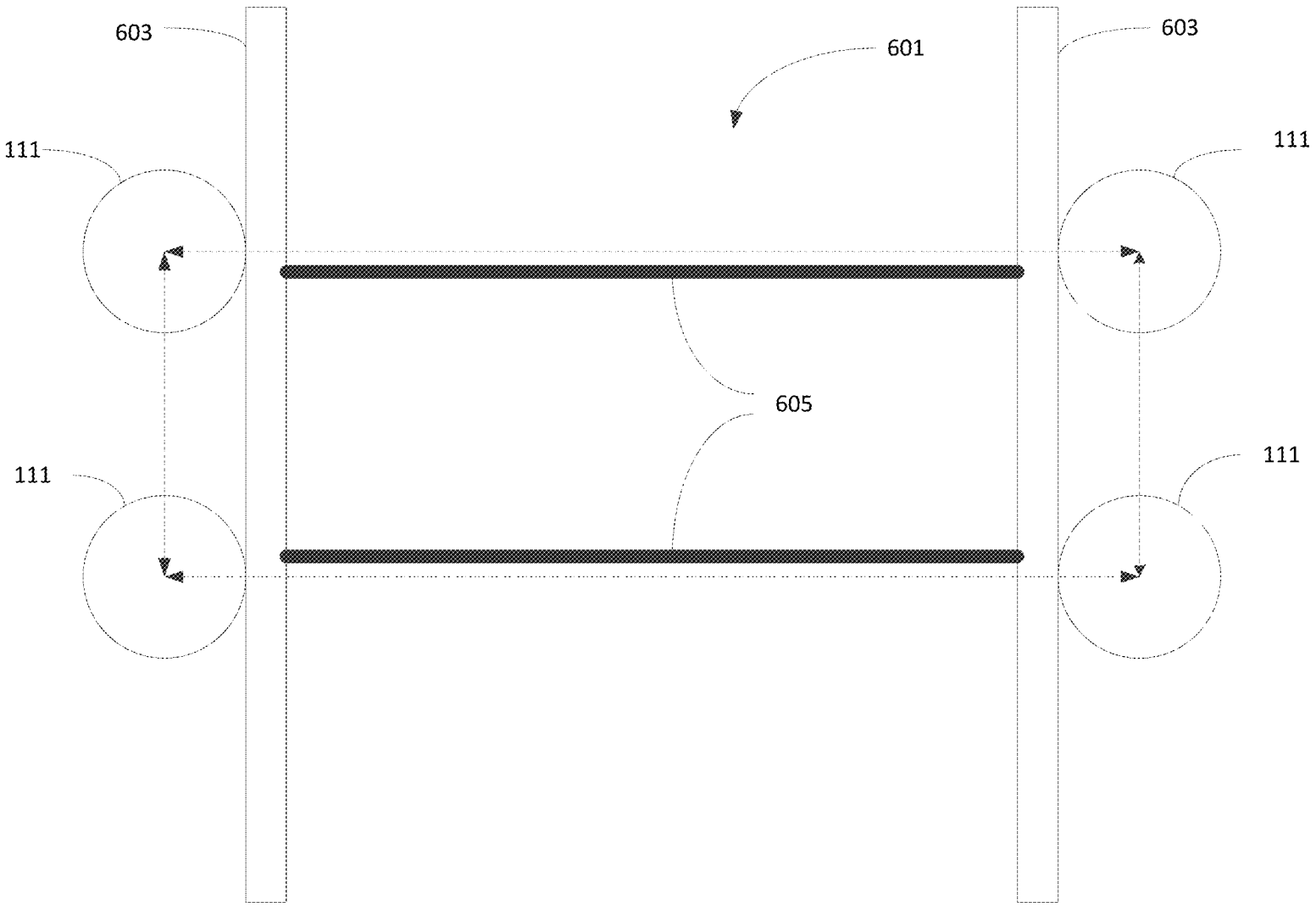
FIG. 6 is a diagram illustrating crosswalk mode in accordance with an exemplary aspect of the disclosure.

The road markers may be programmed to operate in additional modes. FIG. 6 is a diagram illustrating a mode for indicating a crosswalk in accordance with an exemplary aspect of the disclosure. A Cross Walk Mode may be a mode in which road markers 111 will indicate a crosswalk. For example, two pairs of road markers 111 may be positioned on an edge of a curb 603 on each side of a street 601. All four road markers 111 may communicate with each other using UWB Bluetooth LE to determine the distance between adjacent road markers 111. One of the road markers 111 designated as a primary marker may broadcast the boundary defined by the four road markers to indicate a crosswalk 605 having dimensions based on the positions of the road markers 111. Instead of four markers 111, two road markers 111 may be programmed to indicate a crosswalk having a predefined distance between crosswalk lines. In one embodiment, the road markers 111 may indicate the crosswalk continuously while the road markers are powered on, or the road markers may indicate a crosswalk during predetermined time periods. In one embodiment, the road markers 111 may include a motion detector, such that when motion is sensed in one side of the street in a vicinity of a road marker (predetermined distance), due to the presence of a pedestrian entering at one end of the crosswalk, a crosswalk is indicated by the road markers 111.

A timing mode may be set in which the road markers 111 indicate a shape of an area of interest based on a schedule. The road markers 111 may be controlled to turn on and off at scheduled dates and/or times.

Another type of mode may include a Virtual Reality mode. A Virtual Reality mode may be set in which information provided from road markers may be used in virtual reality or augmented reality display. For example, the indication of an area of interest may be displayed in a vehicle smart display 131 by augmenting a display of an actual view of an area with a computer generated boundary that portrays a boundary of the area of interest. As another example, the area of interest and associated boundary may be computer generated as a virtual reality scene.

The area of interest may indicate an area that the vehicle should know of in order to take one or more actions with respect to the area. The information about the area of interest may be broadcast to automotive vehicles 130 in a vicinity of the area of interest 105, or may be transmitted to a network 120. For example, if construction is taking place within one lane of a two lane road, the road markers 111 could be placed around the area of construction to automatically transmit to the network 120 information to indicate the location of the construction. The information that is broadcast to the vehicles 130 directly or transmitted to the network 120 enables automotive vehicles 130 in the area to initiate one or more actions regarding the area of interest 105 or to reroute to a route that avoids the area of interest all together.

In some embodiments, the road markers 111 may broadcast the location of an area of interest to one or more static compute modules in the vicinity of the area of interest for transmission to a network 120 or vehicles 130 connected to a network. For example, if the road markers 111 are used to mark an area of interest in an intersection, the road markers 111 may broadcast the location of the area of interest to a compute module at the intersection for transmission to a wider network including automotive vehicles and other intersections.

In one embodiment, a vehicle may be required to be registered with a service that is accessible through the network 120. For example, a vehicle may be registered with a certain cloud service. Examples of cloud services that are related to travel and navigation include Google Maps, Apple Maps, Waze and other map services.

In some embodiments, multiple road markers may connect to one another automatically via any particular frequency of radio transmission using an ultra-wide band (UWB) connection. Such a connection may provide for high data transfer rates but have a relatively low energy consumption rate. The high data rates may allow transmission of detailed information about an area of interest. The relatively short range of UWB may not affect applications, because the areas of interest demarked by road markers may be relatively small.

In some embodiments, road markers may form a mesh network, in which road markers communicate with each other to determine distance between each pair of road markers. One or more of the road markers may calculate a shape based on the distance between the road markers. Once shape is established, the one or more road markers may communicate with a network 120 or vehicle(s) 130 to report the shape.

In some embodiments, certain road markers may be implemented as a primary device(s), which may be a road marker that has a full complement of hardware (controller and sensors). The road markers that are primary devices may be identified by, for example, a certain color or label (e.g., a blue road marker). In one embodiment, the primary device having a full complement of hardware may be located in a vehicle, or other external device. The road markers may include only minimal hardware (communications module) that can perform distance determination and external communication. If all road markers are primary devices, each road marker may be equipped with a complement of inexpensive hardware components.

Figure 7:
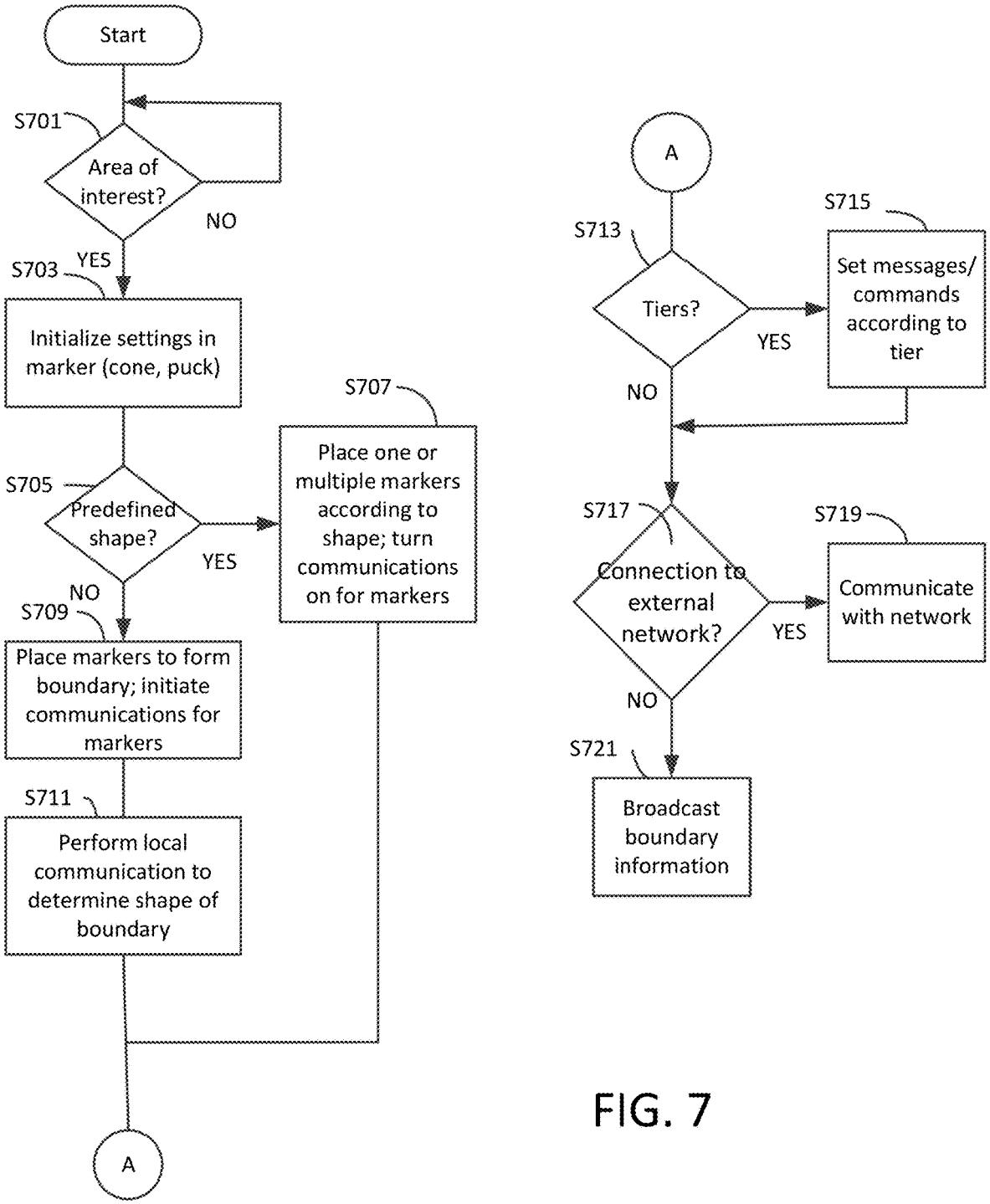
FIG. 7 is a flowchart for dynamic operation of wide-band road markers in accordance with an exemplary aspect of the disclosure.

FIG. 7 is a flowchart for operation of road markers in accordance with an exemplary aspect of the disclosure. A computer/controller in one of the road markers 111 or in a location in the vicinity of the road markers performs processing and communications. Although the flowchart designates a sequence of steps, the steps may be performed in different sequences. For example, a decision to use tiers may be made as an earlier step, and a decision to communicate directly with automotive vehicles or communicate with a network may be made as an earlier step. The flowchart illustrates actions that may be taken based on certain decisions. In S701, detection of an area of interest is made. An area of interest may be a road work zone, work that affects an area of the road such as tree trimming, power line maintenance, a disabled vehicle, a traffic accident, a pothole, or anything that would cause an area of the road, including a side of the road, to be dangerous for vehicles to go through. The area of interest may be determined beforehand in the case of scheduled road work, or may be detected based on a communication. For example, a person involved in a disabled vehicle or a traffic accident may inform a third party, or the police, of the incident and related information such as location. Once an area of interest is detected, one or more road markers may be taken to and placed at or near the area of interest. In some embodiments, in S703, the road markers may be initialized with certain settings, including a notification schedule, a tier specification, whether communication will be by broadcasting or transmission to a network, or both, whether a shape of an area of interest is to be predefined, or is to be determined by the arrangement of road markers.

In some embodiments, the operation of road markers is fully automatic. The road markers may power on when placed on the ground and may communicate with one another to determine distances and a shape of their arrangement, and may automatically begin broadcasting the shape indicating the area of interest.

In S705 (YES), if a road marker is set for a predetermined shape, in S707, one road marker 111 may be placed in the vicinity of the area of interest and may communicate the shape indicating the area of interest. In some embodiments, multiple road markers may be arranged according to the predefined shape. If automotive vehicles that are expected to approach the area of interest are autonomous vehicles or vehicles equipped with certain sensors, it may not be necessary to arrange a full set of road markers to visually indicate an area of interest. For example, two road markers 111 may be arranged to indicate a length of one side of a triangle or square shape, and the road markers may communicate the predefined shape and dimensions based on the two road markers 111. In some embodiments, once the road markers 111 are positioned, communications may be initiated in the road markers 111.

In fully automated road markers, in S709, placement of road markers on the ground may cause initiation of processing, including powering on, and initiating communications. In S711, road markers 111 may begin communication with other road markers 111 (for example in mesh communications) to determine distances and shape of the arrangement of markers. In S713 (YES), if the road markers are set for tiers, in S715, messages and commands will be modified according to settings for tiers. Once a shape of an arrangement of road markers is determined, and any other settings are made including tiers, in S717, one or more road markers may begin communicating the shape and location of the area of interest. If the road markers 111 are equipped for broadcast communications (NO in S717), in S721, the shape (including dimensions) and location of the area of interest may be broadcast to oncoming automotive vehicles 130. In some embodiments (YES in S717), in S719, the road markers 111 may communicate the shape (including dimensions) and location of an area of interest by transmitting the information to a network 120. In some embodiments, in the road markers 111 may communicate shape and location information both by broadcasting the information and by transmitting the information to a network 120.

Although the road markers 111 may communicate shape (including dimensions) and location information for an area of interest, other information may be communicated as well. For example, a message may include information about the type of area of interest, such as road work zone, disabled vehicle, traffic accident, or in the case of crosswalk mode, crosswalk. A message may include information about a time schedule that the area of interest will be in effect.

Numerous modifications and variations are possible in light of the above teachings. It is therefore to be understood that within the scope of the appended claims, the invention may be practiced otherwise than as specifically described herein.

Thus, the foregoing discussion discloses and describes merely exemplary embodiments of the present invention. As will be understood by those skilled in the art, the present invention may be embodied in other specific forms without departing from the spirit or essential characteristics thereof. Accordingly, the disclosure of the present invention is intended to be illustrative, but not limiting of the scope of the invention, as well as other claims. The disclosure, including any readily discernible variants of the teachings herein, defines, in part, the scope of the foregoing claim terminology such that no inventive subject matter is dedicated to the public.

What is claimed is:

1. A method of dynamically communicating information of an area of interest, the method comprising:

powering on and initiating communications with a plurality of marker devices;

determining a peripheral shape indicated by the plurality of marker devices as the information of the area of interest; and communicating the information from the plurality of marker devices, wherein the information identifies a plurality of tiers, and the tiers are defined by boundaries matching the peripheral shape and located in a region extending to a predetermined distance outside of the peripheral shape.

2. The method of claim 1, further comprising determining a distance between pairs of the plurality of marker devices based on time of flight communications;

determining the peripheral shape based on the distance between the plurality of marker devices.

3. The method of claim 1, wherein the peripheral shape is communicated to a vehicle by way of a communications network.

4. The method of claim 1, wherein the peripheral shape is broadcast directly from at least one marker device of the plurality of marker devices to at least one vehicle.

5. The method of claim 1, wherein the peripheral shape is a predetermined shape.

6. The method of claim 5, wherein the predetermined shape is a triangle.

7. The method of claim 5, wherein the predetermined shape is a circle.

8. The method of claim 1, wherein a tier, of the plurality of tiers, adjacent to the boundary at the peripheral shape is a warning tier in which vehicles entering the warning tier will receive a warning indication concerning the area of interest.

9. The method of claim 1, wherein the peripheral shape is indicated by the plurality of the marker devices and the peripheral shape is formed as overlapping shapes as the information of the area of interest.

10. An apparatus for dynamically communicating information of an area of interest, the apparatus being a road marker device comprising:

processing circuitry configured to determine a peripheral shape indicated by the road marker device and at least a second road marker device as the information of the area of interest; and communicate the information, wherein the information identifies a plurality of tiers, and the tiers are defined by boundaries matching the peripheral shape and located in a region extending to a predetermined distance outside of the peripheral shape.

11. The apparatus of claim 10, further comprising:

a piezoelectric material to generate current for powering the processing circuitry.

12. The apparatus of claim 10, wherein the processing circuitry is further configured to determine a distance to the second road marker device based on time of flight communications; and determine the peripheral shape based on the distance between the road marker device and the second road marker device.

13. The apparatus of claim 10, further comprising an infrared reflective coating at least covering a portion of the road marker device.

14. The apparatus of claim 10, wherein the processing circuitry is configured to communicate with the second road marker device in a mesh network.

15. The apparatus of claim 10, wherein the processing circuitry is configured to communicate with an external network.

16. The apparatus of claim 10, wherein the processing circuitry is configured to communicate with an automotive vehicle.

17. The apparatus of claim 16, wherein the automotive vehicle is an autonomous vehicle.

18. The apparatus of claim 10, wherein the processing circuitry includes wireless communication circuitry for receiving and storing initial settings and program instructions.

19. The apparatus of claim 10, wherein the processing circuitry is configured to communicate with a vehicle.

20. An apparatus for dynamically communicating information of an area of interest, the apparatus being a road marker device comprising:

processing circuitry configured to determine a peripheral shape indicated by the road marker device and at least a second road marker device as the information of the area of interest; and communicate the information, wherein the road marker device has a power-save setting, in which the road marker device maintains a communication with an external network, while the second road marker device is switched to a power that is lower than full operation power that is sufficient for receiving and responding to a wake up communication signal from the road marker device.

* * * * *